US009044978B2

(12) United States Patent
Kawaguchi

(10) Patent No.: US 9,044,978 B2
(45) Date of Patent: Jun. 2, 2015

(54) HEAT SOURCE UNIT AND ERASING APPARATUS USING THE HEAT SOURCE UNIT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takahiro Kawaguchi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/258,231

(22) Filed: Apr. 22, 2014

(65) Prior Publication Data

US 2014/0320580 A1 Oct. 30, 2014

(30) Foreign Application Priority Data

Apr. 26, 2013 (JP) ..... 2013-093753

(51) Int. Cl.
*B41J 29/26* (2006.01)
*B41J 2/325* (2006.01)

(52) U.S. Cl.
CPC . *B41J 29/26* (2013.01); *B41J 2/325* (2013.01)

(58) Field of Classification Search
CPC ..... B41J 2/325; B41J 29/26; B41J 2202/31
USPC ..... 347/171, 179, 197
See application file for complete search history.

(56) References Cited

U.S. PATENT DOCUMENTS

| | | | | |
|---|---|---|---|---|
| 6,267,520 | B1 * | 7/2001 | Unno et al. | 400/663 |
| 8,670,012 | B2 * | 3/2014 | Mizutani et al. | 347/179 |
| 8,878,884 | B2 | 11/2014 | Kawaguchi et al. | |
| 2012/0306985 | A1 | 12/2012 | Iguchi et al. | |
| 2013/0002782 | A1 * | 1/2013 | Kawaguchi et al. | 347/179 |
| 2013/0242025 | A1 | 9/2013 | Yamaguchi | |
| 2013/0267412 | A1 | 10/2013 | Kawaguchi | |

FOREIGN PATENT DOCUMENTS

| | | |
|---|---|---|
| JP | 03-110461 | 11/1991 |
| JP | 07-084421 | 3/1995 |
| JP | 2006-064727 | 3/2006 |
| JP | 2013-011864 | 1/2013 |
| JP | 2013-011886 | 1/2013 |

OTHER PUBLICATIONS

Japanese Office Action for Japanese Patent Application No. 2013-093753 mailed on Dec. 24, 2014.

* cited by examiner

*Primary Examiner* — Sarah Al Hashimi
(74) *Attorney, Agent, or Firm* — Amin, Turocy & Watson, LLP

(57) ABSTRACT

A heat source opening and closing mechanism, around a rotation shaft of which a plurality of spring members are wound, is opened and closed an outside unit including a first heating member and a second press roller against an inside unit including a second heating member and a first press roller. The heat source opening and closing mechanism is opened and closed among a closed position where the first press roller faces to the first heating member and the second press roller faces to the second heating member, a first open state in which the load by the outside unit is commensurate with a first elastic force of the spring member, and a second open state in which an opening angle is larger than that in the first open state.

8 Claims, 6 Drawing Sheets

HEAT SOURCE UNIT AND ERASING APPARATUS USING THE HEAT SOURCE UNIT

CROSS-REFERENCE TO RELATED APPLICATION

This application is based upon and claims the benefit of priority from Japanese Patent Application No. 2013-093753, filed Apr. 26, 2013, the entire contents of which are incorporated herein by reference.

FIELD

Embodiments described herein relate to a heat source unit and an erasing apparatus which uses the heat source unit.

BACKGROUND

Conventionally, in an image forming apparatus which heats and presses the toner on an electronic photograph and the like to fix the toner on the paper, as a method for removing papers jammed in a fixing apparatus or papers stopping when passing through the fixing apparatus, a method of rotating a conveyance rib contacting with a press roller and a heat roller, or a method of releasing the pressure between the press roller and the heat roller is widely used to draw the papers out.

DETAILED DESCRIPTION

In accordance with one embodiment, a heat source unit comprises a first heating member configured at one side of a paper at the upstream side of a paper conveyance direction to heat the paper from the one side; a first press roller configured opposite to the first heating member to press the paper from the other side against the first heating member, and meanwhile rotate to convey the paper in the conveyance direction; a second heating member configured at the other side of the paper at the downstream side of the first press roller in the paper conveyance direction to heat the paper from the other side; a second press roller configured opposite to the second heating member to press the paper from the one side against the second heating member, and meanwhile rotate to convey the paper in the conveyance direction; and a heat source opening and closing mechanism, around a rotation shaft of which a plurality of spring members are wound, configured to be opened and closed by rotating an outside unit including the first heating member and the second press roller against an inside unit including the second heating member and the first press roller; wherein the heat source opening and closing mechanism is opened and closed among a closed position where the first press roller faces to the first heating member and the second press roller faces to the second heating member, a first open state in which the load by the outside unit is commensurate with a first elastic force of the spring member, and a second open state in which an opening angle is larger than that in the first open state, and the combination force of the load by the outside unit and a pressure force applied in the first open state in the open direction of the heat source is commensurate with a second elastic force of the spring member.

Hereinafter, the embodiment is described in detail with reference to the accompanying drawings.

Figure 1:
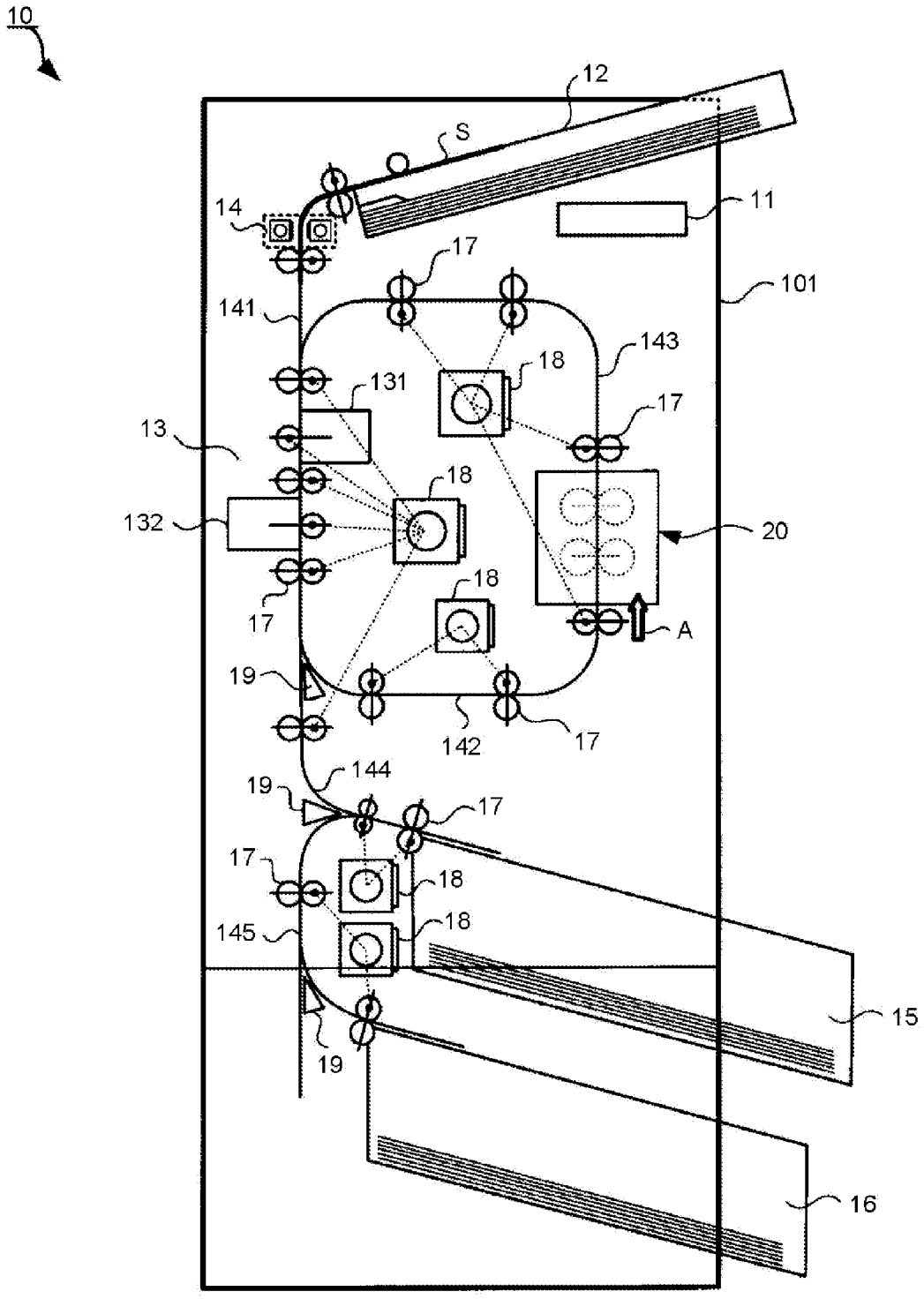
FIG. 1 is a schematic view illustrating an example of the entire constitution of an erasing apparatus provided with a heat source unit according to one embodiment.

FIG. 1 is a schematic view illustrating an example of an entire constitution of an erasing apparatus 10 to which a heat source unit according to the present embodiment is applied. The erasing apparatus 10 comprises an operation panel 11 including operation buttons and a display section, a paper feed section 12, a scanner 13 serving as a reading section, a ultrasonic sensor 14 for detecting the conveyance state of paper S and an erasing section 20 serving as a heat source unit for erasing an image on the paper S. In addition to a first conveyance path 141, a second conveyance path 142, a third conveyance path 143, a fourth conveyance path 144 and a fifth conveyance path 145, the erasing apparatus 10 further comprises a first paper discharge tray 15 and a second paper discharge tray (reject box) 16 serving as paper discharge sections.

Each of the conveyance paths 141~145 is provided with a plurality of conveyance rollers 17 to convey the paper S, and a plurality of motors 18 to drive each conveyance roller 17. Further, each of the conveyance paths 141~145 is provided with a plurality of gates 19 to correctly convey the paper S to each of the conveyance paths 141~145.

The first conveyance path 141 conveys the paper S from the paper feed section 12 to the scanner 13. The second conveyance path 142 conveys the paper S from the scanner 13 to the erasing section 20 along a direction indicated by an arrow A. The third conveyance path 143 conveys the paper S from the erasing section 20 to the scanner 13 again. The fourth conveyance path 144 conveys the paper S from the scanner 13 to the first paper discharge tray 15. The fifth conveyance path 145 conveys the paper S from the scanner 13 to the second paper discharge tray (reject box) 16.

The first paper discharge tray 15 collects, for example, a reusable paper S the image on which is erased. The second paper discharge tray (reject box) 16 collects a not-reusable paper S which is generally scraped and recycled.

The erasing apparatus 10 mainly carries out the following operations (1)-(5):

(1) reading the paper S fed from the paper feed section 12 by the first conveyance path 141 using the scanner 13. The scanner 13 includes a first scanner 131 and a second scanner 132 to read two sides of the paper S. The scanner 13 reads, for example, image data before the image on the paper S is erased. Simultaneously, the scanner 13 reads the printing state of the paper S.

(2) storing the image data read by the scanner 13. Further, according to the printing state of the paper S read by the scanner 13, if the paper S is ripped or crumpled, the paper S is guided to the fifth conveyance path 145 and then conveyed to the reject box 16. The paper S without any rip or crumple is conveyed to the erasing section 20 by the second conveyance path 142.

(3) heating the paper S conveyed to the erasing section 20 when the paper S passes through the erasing section 20 to erase the image formed on the paper S by heating. The erasing section 20 heats and presses the paper S at a relatively high temperature of, for example, 180~200 degrees centigrade, to erase the image on the paper S. The detailed constitution of the erasing section 20 is described later.

(4) conveying the paper S passing through the erasing section 20 to the scanner 13 again by the third conveyance path 143. The scanner 13 reads the printing state of the paper S again to confirm whether or not the image formed with erasable coloring agent in an image area is actually erased.

(5) conveying the reusable paper S to the first paper discharge tray 15 by the fourth conveyance path 144. According to the printing state of the paper S read by the scanner 13, if there is an image formed with inerasable coloring agent or a handwritten image left in the image area of the paper S, or if the paper S is ripped or crumpled, the paper S is conveyed to the reject box 16 by the fifth conveyance path 145.

Figure 2:
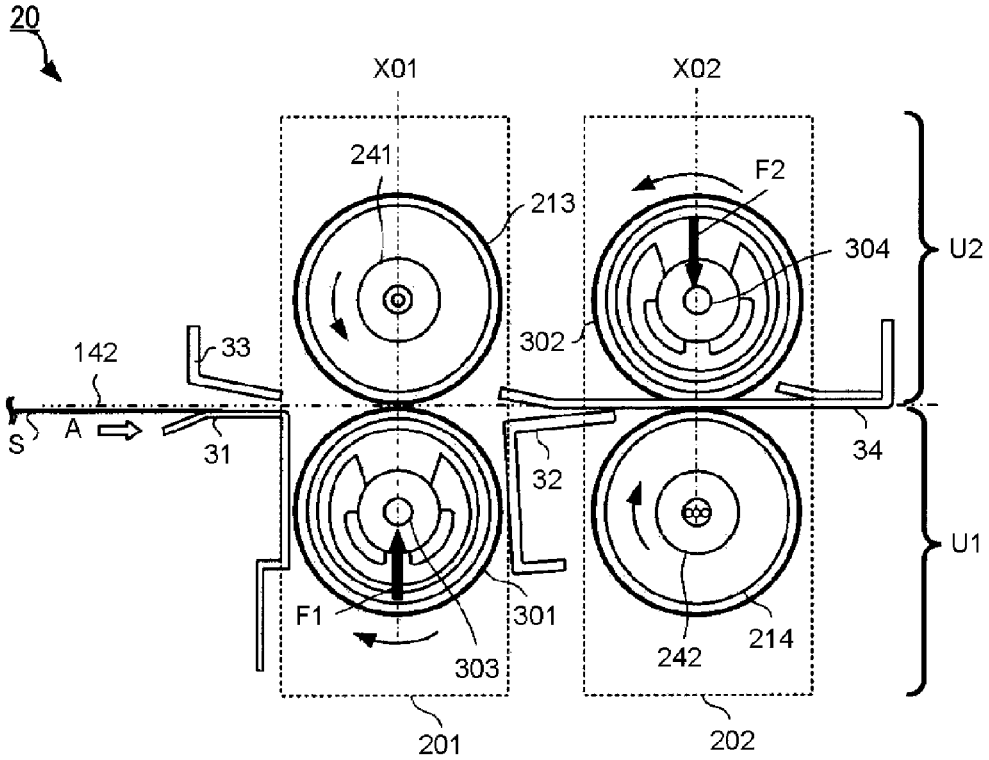
FIG. 2 is a cross-sectional view illustrating the internal structure of the erasing section shown in FIG. 1.

FIG. 2 is a cross-sectional view illustrating a concrete example of the internal structure of the erasing section 20. The erasing section 20 conveys the paper S on the conveyance path, while heating the paper S fed by the paper feed section 12 with a heat source at a given heat source setting temperature, so as to erase the image on the paper S. As shown in FIG. 2, the erasing section 20 has a first erasing section 201 and a second erasing section 202. The first erasing section 201 includes a first heat roller 213 serving as a heating member and a first press roller 301 serving as a pressing member. Similarly, the second erasing section 202 includes a second heat roller 214 and a second press roller 302. Though the first erasing section 201 is structurally identical to the second erasing section 202, the arrangement positions of the heat rollers and the press rollers are reversed in a vertical direction. The first press roller 301 and the second press roller 302 are cylindrical rotation rollers which extend in a width direction of the paper S and rotate around rotation axes 303 and 304, respectively.

The paper S is conveyed on the second conveyance path 142 from a direction indicated by an arrow A. The direction indicated by the arrow A is equivalent to the direction indicated by the arrow A in FIG. 1. The first heat roller 213 and the second heat roller 214 are respectively provided with cylindrical halogen heaters 241 and 242. A paper guide 31 is arranged at a paper conveying-in side and a paper guide 32 is arranged at a paper conveying-out side. The paper guide 31 guides the conveying-in of the paper S together with a paper guide 33. The paper guide 33 is fixed in the erasing apparatus 10 opposite to the paper guide 31. The paper guide 32 guides the conveying-out of the paper S together with a paper guide 34. The paper guide 34 is fixed in the erasing apparatus 10 opposite to the paper guide 32. The paper guides 32 and 34 guide the conveyance of the paper S in the second erasing section 202.

The first press roller 301 and the second press roller 302 are cylindrical rotation rollers which are respectively contacted with the first heat roller 213 and the second heat roller 214 in a longitudinal direction thereof, and rotate around the rotation axes 303 and 304, respectively. The first press roller 301 and the second press roller 302 are formed by, for example, contacting a tube having mold releasability with the surface of an elastic body such as a silicon sponge and the like. The rotation axes 303 and 304 are energized in the directions of the first heat roller 213 and the second heat roller 214, respectively, thereby clamping, pressing and heating the paper S between the first heat roller 213 and the first press roller 301, and then between the second heat roller 214 and the second press roller 302, while conveying the paper S.

A pressure (pinch pressure) for energizing the first press roller 301 towards the direction of the first heat roller 213 in the first erasing section 201 is indicated by F1. A pressure (pinch pressure) for energizing the second press roller 302 towards the direction of the second heat roller 214 in the second erasing section 202 is indicated by F2. The ratio of the pinch pressure F1 to the pinch pressure F2 is, for example, 3:2.

For example, the rotation shaft 303 is pulled by a spring towards the side of the first heat roller 213 due to the application of the pinch pressure F1. Further, for example, the rotation shaft 304 is pulled by a spring towards the side of the second heat roller 214 due to the application of the pinch pressure F2.

An erasing processing carried out on the paper S by the first erasing section 201 and the second erasing section 202 is described below. The paper S is guided by the paper guides 31 and 33, and conveyed to the erasing section 20 through the second conveyance path 142. The press roller 301 of the first erasing section 201 and the press roller 302 of the second erasing section 202 are rotated in opposite directions, thereby conveying the paper S in the direction indicated by the arrow A at a preset speed.

The first press roller 301 is pressed against and contacted with the first heat roller 213 through the pinch pressure F1 in the first erasing section 201 at the upstream side of the conveyance path. A contact point (one dotted lines X01) of the first press roller 301 and the first heat roller 213 forms a nip area where heat is transferred to the paper S, and the surface of the paper is heated and the image formed on one side of the paper S is erased by conveying the paper S through the nip area X01.

In a case where the image is formed on the paper S with erasable coloring agent, the coloring agent is erased at a certain temperature. The first heat roller 213 is uniformly heated by a cylindrical halogen heater 241 and maintained at an erasing temperature. The temperature of the first heat roller 213 is detected by a thermistor (not shown), and the first heat roller 213 is maintained at a proper temperature based on the result of the temperature detection.

The paper S, after being discharged from the first erasing section 201, is guided by the paper guides 32 and 34, and conveyed into the second erasing section 202. In the second erasing section 202 at the downstream side of the conveyance path, the position relation of the second press roller 302 and the second heat roller 214 is opposite to that in the first erasing section 201 in the vertical direction, and the second press roller 302 is pressed against and contacted with the second heat roller 214 through the pinch pressure F2.

A contact point (one dotted lines X02) of the second press roller 302 and the second heat roller 214 forms a nip area where heat is transferred to the paper S. The surface of the paper is heated and the image formed on the other side of the paper S is erased by conveying the paper S through the nip area X02. The paper S both sides of which are color erased is discharged along the paper guide 34, and then conveyed to the third conveyance path 143.

Though the first erasing section 201 is structurally identical to the second erasing section 202, the arrangement position of the heat roller and press roller in the first erasing section 201 is opposite to that in the second erasing section 202, and each roller is arranged in series, therefore, the image formed on one side of the paper S is erased by the first erasing section 201, and the image formed on the other side of the paper S is erased by the second erasing section 202. Thus, the image formed on two sides of the paper S can be erased efficiently.

Figure 3:
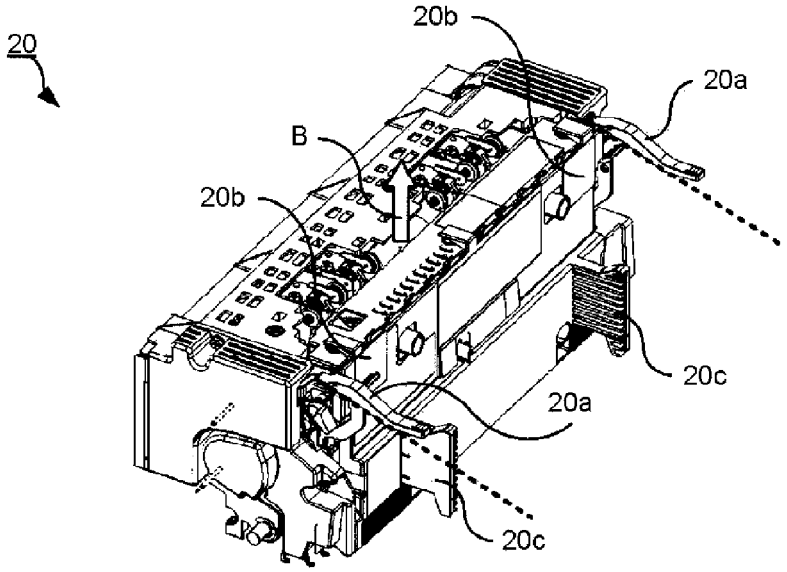
FIG. 3 is an oblique view illustrating the erasing section shown in FIG. 2.

FIG. 3 is an oblique view illustrating the erasing section 20 shown in FIG. 2. As shown in FIG. 3, a pair of opening and closing levers 20*a* is arranged at two ends of the erasing section 20. A pair of felts 20*b* serving as insulation material is respectively attached near the fulcrums of the pair of opening and closing levers 20*a* on the side of the erasing section 20. Further, a pair of handles 20*c* is arranged below the pair of felts 20*b* for an operator to use when opening the erasing section 20. The surface of the pair of handles 20*c* is covered with insulation material. The direction indicated by an arrow B represents the conveyance direction of the paper S.

Figure 4:
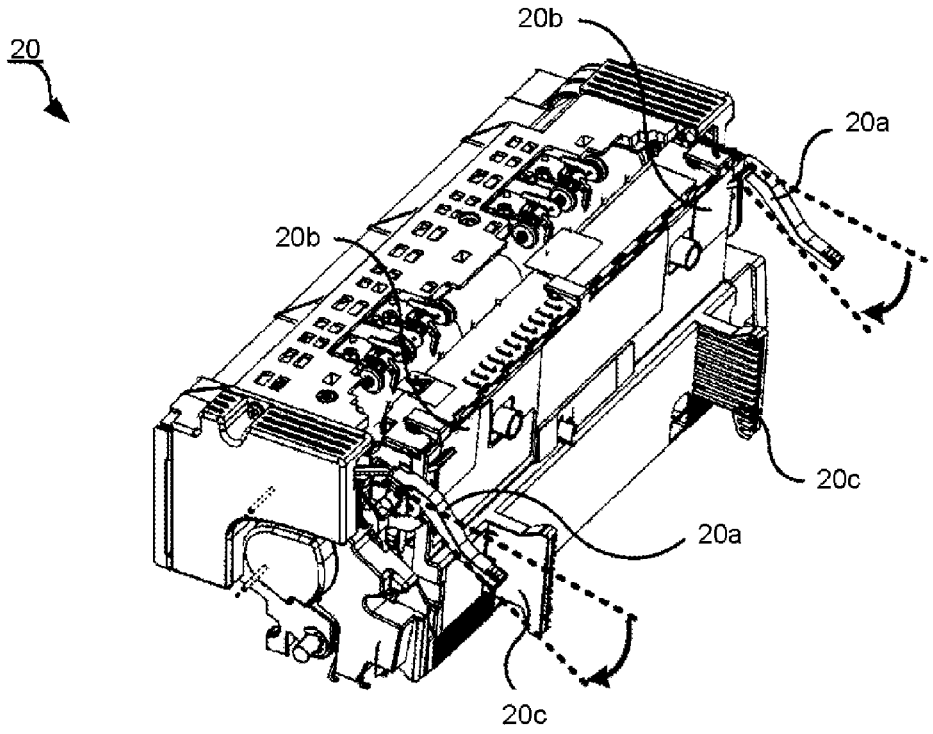
FIG. 4 is an oblique view illustrating a state in which opening and closing levers of the erasing section shown in FIG. 3 are released.
Figure 5:
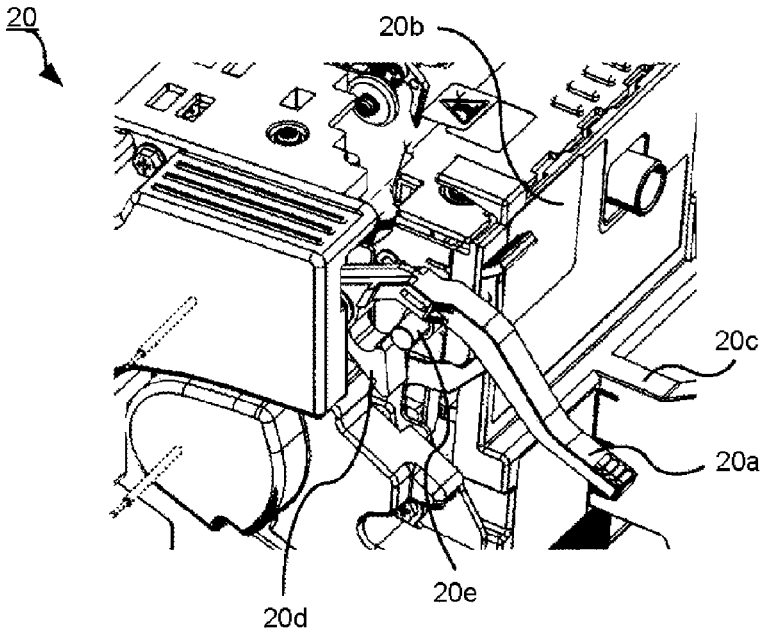
FIG. 5 is an enlarged oblique view illustrating the main portions of FIG. 4.

FIG. 4 is an oblique view illustrating a state in which the engagement of a hook portion 20*d* of the opening and closing lever 20*a* of the erasing section 20 shown in FIG. 3 with a rotation shaft is released, and FIG. 5 is an enlarged oblique view illustrating the main portions of FIG. 4. As shown in FIG. 4, the pair of opening and closing levers 20*a* can be pressed downwards (a direction indicated by an arrow in FIG. 4). At this time, as shown in FIG. 5, if the connection of the hook portion 20*d* formed in a hook shape at the other end of the pair of opening and closing levers 20*a* with a lock shaft 20*e* is released, the erasing section 20 (heat source unit), which is fixed in a closed state at a contact position where the first press roller 301 contacts with the first heat roller 213 and the second press roller 302 contacts with the second heat roller 214, can be opened. The contact position is, in other words, a state in which the first press roller 301 is opposite to the first heat roller 213 and the second press roller 302 is opposite to the second heat roller 214, and in which the paper can be conveyed.

Figure 6:
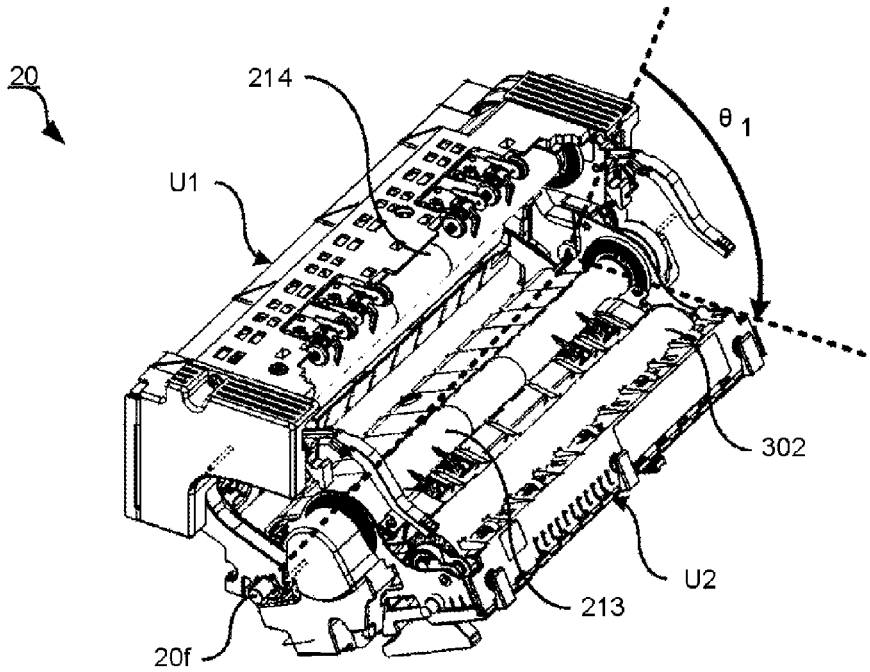
FIG. 6 is an oblique view illustrating an open state of a first stage in the erasing sections shown in FIG. 3.
Figure 7:
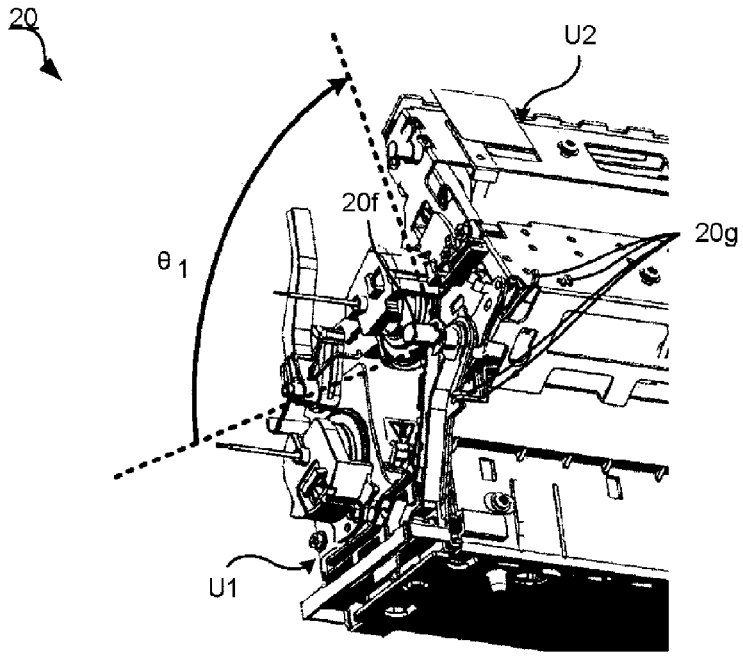
FIG. 7 is an, oblique view illustrating the open state of the first stage in the erasing sections shown in FIG. 6.

FIG. 6 and FIG. 7 are oblique views respectively illustrating an open state of a first stage in the erasing section 20 shown in FIG. 3. FIG. 6 is a diagram viewed from the side of an open port of the heat source, on the contrary, FIG. 7 is a diagram viewed from the side of a torsion spring 20*g*. When the connection of the hook portion 20*d* of the opening and closing lever 20*a* with the lock shaft 20*e* is released, in the heat source opening and closing mechanism of the erasing section 20, an outside unit U2 including the first heat roller 213 and the second press roller 302 rotates around a rotation shaft 20*f* against an inside unit U1 including the second heat roller 214 and the first press roller 301, thereby opening the heat source opening and closing mechanism. Further, as shown in FIG. 7, in the heat source opening and closing mechanism of the erasing section 20, a plurality of torsion springs 20*g* are wound around the rotation shaft 20*f*, and the elastic force of the torsion springs 20*g* acts in a closing direction. Therefore, the heat source opening and closing mechanism of the erasing section 20 rotates around the rotation shaft 20*f* until it reaches the first open state in which the load (own weight) by the outside unit U2 is commensurate with the first elastic force of the torsion spring 20*g*. It is preferred to select and adjust the torsion spring 20*g* having such an elastic modulus that an opening angle $\theta_1$ of the heat source opening and closing mechanism in the first open state can be kept at, for example, about 60 degrees. In the present embodiment, compared with a coil spring, the torsion spring 20*g* has an advantage in strong elastic force generated when pressed by the same weight and an advantage in light weight, thus, the torsion spring 20*g* is used as the spring member, however, other spring such as the coil spring may also be used. Further, the number of the torsion spring 20*g* is not limited.

Figure 8:
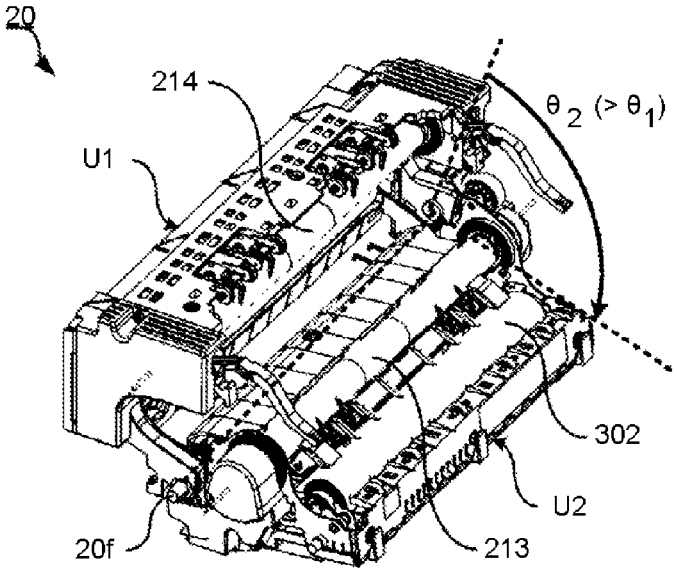
FIG. 8 is an oblique view illustrating an open state of a second stage in the erasing section shown in FIG. 3.
Figure 9:
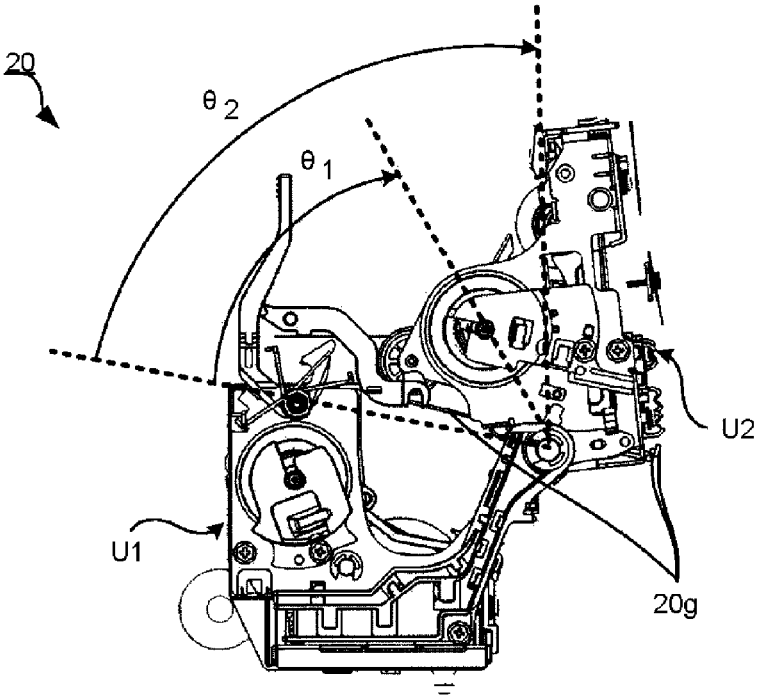
FIG. 9 is a side view illustrating the open state of the second stage in the erasing section shown in FIG. 8.
Figure 10:
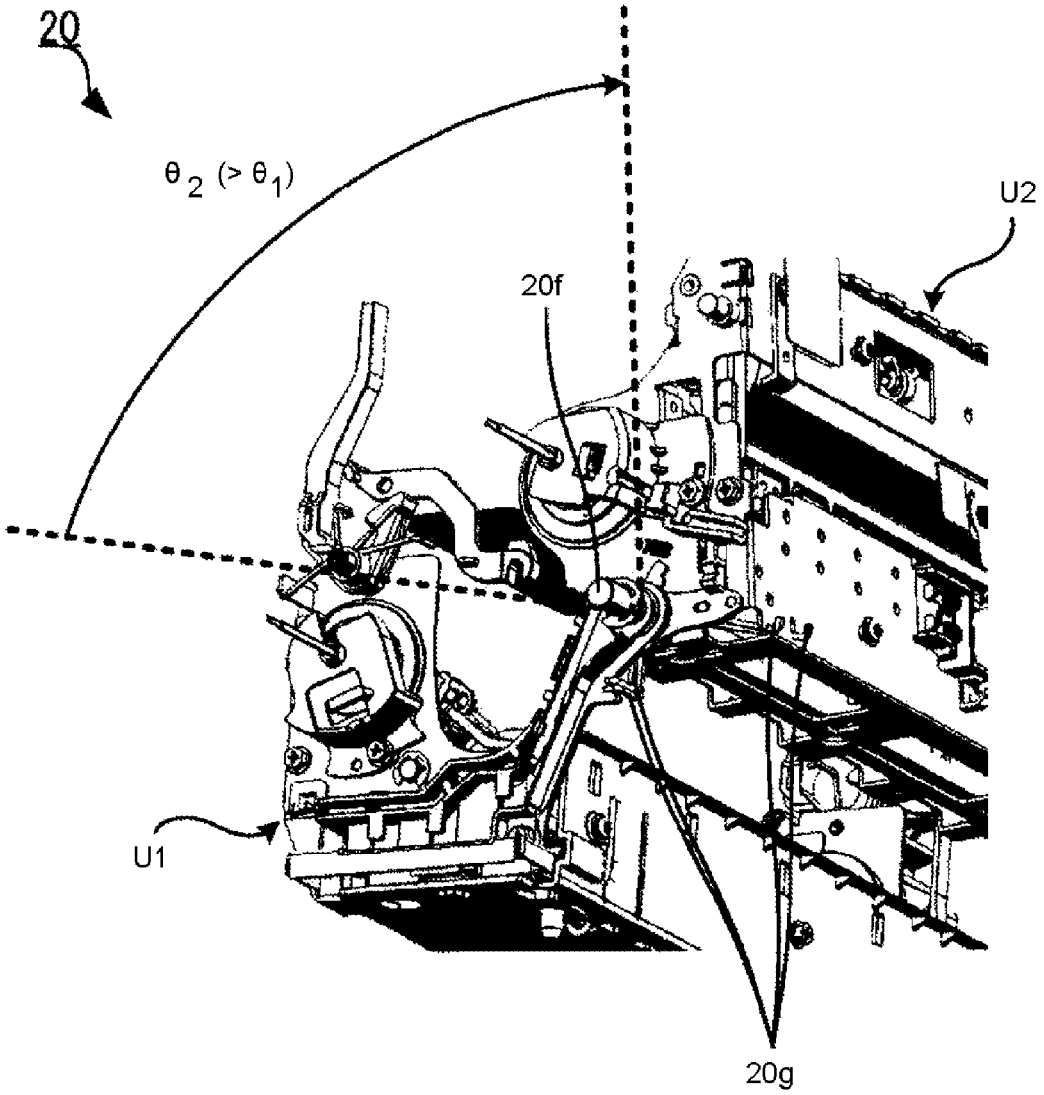
FIG. 10 is an oblique view illustrating the open state of the second stage in the erasing section shown in FIG. 8.

FIG. 8 and FIG. 9 are an oblique view and a side view respectively illustrating an open state of a second stage in the erasing section 20 shown in FIG. 3. FIG. 10 is an oblique view viewed (contrary to FIG. 8) from the side of the torsion spring 20*g*. In the open state of the first stage shown in FIG. 6 and FIG. 7, if the operator further presses the outside unit U2, the heat source opening and closing mechanism of the erasing section 20 further rotates around the rotation shaft 20*f* until it reaches the second open state in which an opening angle $\theta_2$ is larger than the opening angle $\theta_1$ in the first open state, and the combination force of the load (own weight) by the outside unit U2 and the pressure force applied by the operator in the first open state in the open direction of the heat source is commensurate with the second elastic force of the torsion spring 20*g*. The maximum value of the opening angle $\theta_2$ is determined according to the range of the motion of the outside unit U2 away from the inside unit U1, and is preferred to be, for example, about 90 degrees. In the second open state, if the operator lets go of the hand, the outside unit U2 is rotated around the rotation shaft 20*f* by the elastic force in the closing direction until it reaches the first open state. Then, in the first open state, for example, if the operator puts thumbs under the pair of handles 20*c* and presses the pair of felts 20*b* with index fingers to apply a force to the outside unit U2 in the closing direction, the outside unit U2 rotates around the rotation shaft 20*f* towards the direction of the inside unit U1, and the opening and closing lever 20*a* is pushed up by interlocking with this, and the hook portion 20*d* is connected with the lock shaft 20*e*, thereby, the outside unit U2 returns to the closed state shown in FIG. 3.

In this way, the heat source opening and closing mechanism which separates the heat rollers 213, 214 and the press rollers 301, 302 to remove the paper S jammed in the heat source unit or the paper S stopping in the heat source unit is adopted in the erasing apparatus 10 in which the heat source unit according to the present embodiment is applied. The heat source opening and closing mechanism has such a structure that the heat rollers 213, 214 and the press rollers 301, 302 in the heat source unit can be separated by taking the rotation shaft 20*f* as a center, and when opening the heat source unit, the heat source unit is opened to a certain angle θ1 first due to the action of the torsion spring 20*g* arranged around the rotation shaft 20*f*, and is opened to a larger angle if being further pressed. The papers stopping in the heat source unit can be pulled out without any obstruction by opening the heat source unit to a certain angle θ1 first. Next, the paper jammed in the heat source unit can be removed easily by further pressing the heat source unit and opening the heat source unit to a larger angle. That is, with such a structure that the heat source unit is opened in stages, the risk that the operator contacts with the heat source having a high temperature in the paper removing operation can be greatly reduced.

Further, in the embodiment described above, it is exemplified the heat source unit is applied to the heat source unit of the erasing apparatus 10; however, the present invention is not limited to this. For example, the heat source unit may also be applied to the heat source unit of a fixing apparatus. In addition, in the present embodiment, the heat rollers 213 and 214 are described as heating members, however, heat plates may also be used.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A heat source unit, comprising:

a first heating member configured at one side of a paper at the upstream side of a paper conveyance direction to heat the paper from the one side;

a first press roller configured opposite to the first heating member to press the paper from the other side against the first heating member, and meanwhile rotate to convey the paper in the conveyance direction;

a second heating member configured at the other side of the paper at the downstream side of the first press roller in the paper conveyance direction to heat the paper from the other side;

a second press roller configured opposite to the second heating member to press the paper from the one side against the second heating member, and meanwhile rotate to convey the paper in the conveyance direction; and a heat source opening and closing mechanism, around a rotation shaft of which a plurality of spring members are wound, configured to be opened and closed by rotating an outside unit including the first heating member and the second press roller against an inside unit including the second heating member and the first press roller; wherein the heat source opening and closing mechanism is opened and closed among a closed position where the first press roller faces to the first heating member and the second press roller faces to the second heating member, a first open state in which the load by the outside unit is commensurate with a first elastic force of the spring member, the first open state having a first opening angle maintained by the first elastic force, and a second open state having a second opening angle which is larger than the first opening angle, and the combination force of the load by the outside unit and the a pressure force applied in the first open state in the open direction of the heat source is commensurate with a second elastic force of the spring member.

2. The heat source unit according to claim 1, further comprising:

a lock shaft configured to fix the heat source opening and closing mechanism at the closed position; and an opening and closing lever configured to switch the opening and closing of the heat source opening and closing mechanism through a connection release or a connection with the lock shaft.

3. The heat source unit according to claim 1, wherein the spring member is a torsion spring.

4. The heat source unit according to claim 1, wherein the first opening angle and the second opening angle of the heat source opening and closing mechanism are adjusted based on the elastic modulus of the spring member.

5. An erasing apparatus, comprising:

a first heating member configured at one side of a paper, on which an image is formed with coloring agent that can be erased by heating, at the upstream side of a paper conveyance direction to heat the paper from the one side;

a first press roller configured opposite to the first heating member to press the paper from the other side against the first heating member, and meanwhile rotate to convey the paper in the conveyance direction;

a second heating member configured at the other side of the paper at the downstream side of the first press roller in the paper conveyance direction to heat the paper from the other side;

a second press roller configured opposite to the second heat member to press the paper from the one side against the second heating member, and meanwhile rotate to convey the paper in the conveyance direction; and a heat source opening and closing mechanism, around a rotation shaft of which a plurality of spring members are wound, configured to be opened and closed by rotating an outside unit including the first heating member and the second press roller against an inside unit including the second heating member and the first press roller; wherein the heat source opening and closing mechanism is opened and closed among a closed position where the first press roller faces to the first heating member and the second press roller faces to the second heating member, a first open state in which the load by the outside unit is commensurate with a first elastic force of the spring member, and a second open state in which an opening angle is larger than that in the first open state, and the combination force of the load by the outside unit and a pressure force applied in the first open state in the open direction of the heat source is commensurate with a second elastic force of the spring member.

6. The erasing apparatus according to claim 5, further comprising:

a lock shaft configured to fix the heat source opening and closing mechanism at the closed position; and an opening and closing lever configured to switch the opening and closing of the heat source opening and closing mechanism through a connection release or a connection with the lock shaft.

7. The erasing apparatus according to claim 5, wherein the spring member is a torsion spring.

8. The erasing apparatus according to claim 5, wherein the opening angle of the heat source opening and closing mechanism is adjusted based on the elastic modulus of the spring member.

* * * * *